US008763754B2

(12) United States Patent
Pieper

(10) Patent No.: US 8,763,754 B2
(45) Date of Patent: Jul. 1, 2014

(54) SOUND INSULATING ELEMENT AND PROCESS FOR PRODUCING A SOUND INSULATING ELEMENT

(75) Inventors: Herbert Pieper, Dülmen (DE); Elisabeth Hildegard Billes-Pieper, legal representative, Dülmen (DE)

(73) Assignee: Rockwool International A/S (DK)

( * ) Notice: Subject to any disclaimer, the term of this patent is extended or adjusted under 35 U.S.C. 154(b) by 0 days.

(21) Appl. No.: 13/319,979

(22) PCT Filed: May 12, 2010

(86) PCT No.: PCT/EP2010/002897

§ 371 (c)(1),
(2), (4) Date: Jan. 18, 2012

(87) PCT Pub. No.: WO2010/130416

PCT Pub. Date: Nov. 18, 2010

(65) Prior Publication Data

US 2012/0103723 A1 May 3, 2012

(30) Foreign Application Priority Data

May 12, 2009 (DE) ..... 10 2009 020 963

(51) Int. Cl.

| | |
|---|---|
| ***E04B 1/84*** | (2006.01) |
| ***E04B 1/82*** | (2006.01) |
| ***B05D 1/12*** | (2006.01) |
| ***B05D 3/02*** | (2006.01) |
| ***B05D 3/10*** | (2006.01) |

(52) U.S. Cl.
USPC ..... 181/294; 181/291; 427/180; 427/337; 427/372.2

(58) Field of Classification Search
USPC ..... 181/294, 291; 427/180, 372.2, 554
See application file for complete search history.

(56) References Cited

U.S. PATENT DOCUMENTS

| | | | | |
|---|---|---|---|---|
| 1,959,057 | A * | 5/1934 | Kliefoth | 181/30 |
| 2,316,093 | A * | 4/1943 | MacNutt | 52/409 |
| 2,874,796 | A * | 2/1959 | Eckert | 181/291 |
| 3,077,945 | A * | 2/1963 | Thomas et al. | 181/284 |
| 3,092,203 | A * | 6/1963 | Feid et al. | 181/291 |
| 3,255,843 | A * | 6/1966 | MacDonald | 181/291 |

(Continued)

FOREIGN PATENT DOCUMENTS

| | | | |
|---|---|---|---|
| DE | 202006000201 | U1 | 5/2006 |
| FR | 1090617 | A | 4/1955 |
| WO | WO 2007042232 | A1 * | 4/2007 |

*Primary Examiner* — David Warren
*Assistant Examiner* — Christina Russell
(74) *Attorney, Agent, or Firm* — John Wilson Jones; Jones & Smith, LLP

(57) ABSTRACT

The invention relates to a sound insulating element for the ceiling area of a building, in particular for rooms subject to increased humidity such as underground parking, and basement rooms, which sound insulating element consists of an insulation element (2) made from mineral fibers bound with a binding agent and having two mutually spaced large surfaces extending parallel to each other, and of a coating (5) from a hydraulically and/or chemically set mass, wherein the coating (5) is connected to the insulation element (2), whereby the coating (5) to be oriented towards the room includes an array of openings (7) forming a regular hole pattern and penetrating the coating (5) as far as to the insulation element (2). The invention moreover relates to a process for producing said sound insulating element.

23 Claims, 2 Drawing Sheets

(56) References Cited

Figure 1:
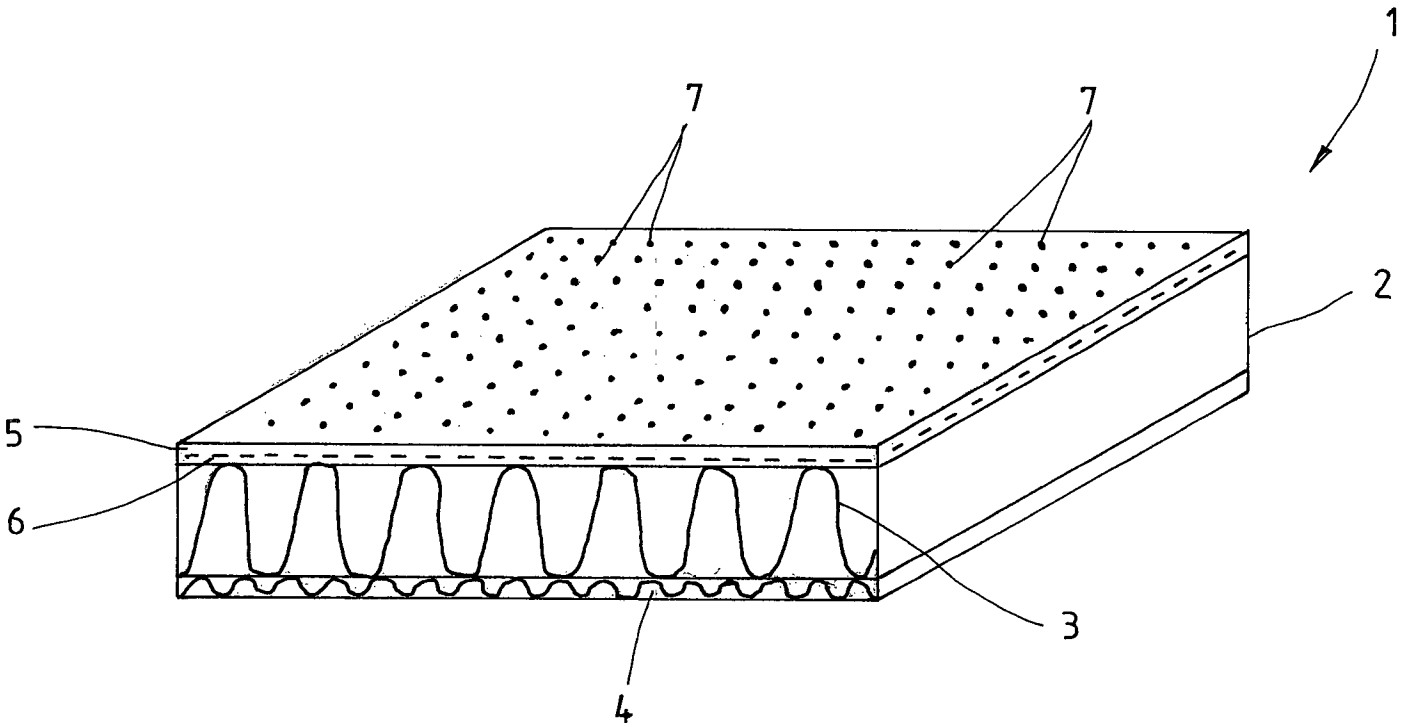

U.S. PATENT DOCUMENTS 3,422,920 A * 1/1969 Sabine et al. ..... 181/291
6,613,424 B1 * 9/2003 Putt et al. ..... 428/312.4
2002/0182959 A1 * 12/2002 Nikolaidis et al. ..... 442/180
2004/0023587 A1 * 2/2004 Bargo, II ..... 442/394
2010/0132273 A1 * 6/2010 Pieper ..... 52/144

* cited by examiner

SOUND INSULATING ELEMENT AND PROCESS FOR PRODUCING A SOUND INSULATING ELEMENT

The invention relates to a sound insulating element for the ceiling area of a building, in particular for rooms subject to increased humidity such as underground parking, swimming pools and basement rooms. The sound insulating element consists of an insulation element made from mineral fibers bound with a binding agent and having two mutually spaced large surfaces extending parallel to each other, and of a coating from a hydraulically and/or chemically set mass, which coating is connected to the insulation element.

The invention moreover relates to a process for producing said sound insulating element.

Sound insulating elements for the ceiling area of a building are known from prior art. Such insulating elements are offered under the name Tektalan by Knauf Insulation GmbH for instance. These insulating elements are wood wool multilayer sheets having a rock wool core. Top layers made from magnesite-bound wood wool are arranged on both sides of an insulation panel from highly bio-soluble rock wool fibers. Though very durable, the surface thus produced is extremely uneven and the sound insulation properties of such a product are rather poor. In this respect reference is made also to EP 1 369 539 B1 which apparently has such a product as its subject matter, as far as this product is concerned with a building product including wood wool fibers having a length >8 cm, a width of 1 to 5 mm and thickness of 0.2 to 0.5 mm. These wood wool fibers are interconnected by an inorganic binder while forming an open-pored structure. The building product additionally comprises a further component, for example a mineral fiber layer which is covered on one or on both sides thereof with the above-described layer from wood wool fibers.

For additional prior art reference is made to DE 696 07 375 T3, comprising a refractory liner plate with at least one insulating layer from mineral wool and with an outer layer on both sides of the insulating layer, the outer layer being made up of a binding agent consisting of magnesium chloride, magnesium sulfate, magnesium oxide, sodium silicate and an acid and a reaction product thereof and including at least one reinforcement.

The above-described insulating elements have very limited sound insulation properties, a rather high bulk density and they produce surfaces when installed which do not meet the today's requirements of a particularly aesthetical sound insulating ceiling.

In view of this prior art, the invention is based on the problem of constructing a sound insulating element in such a way that excellent sound insulation properties are achieved and that a sound insulating ceiling having an aesthetic appearance and usable as a lost formwork during installation can be constructed from this sound insulating element, especially in rooms subject to an increased humidity.

The invention is further based on the problem of providing a process allowing easy manufacture of corresponding insulating elements in a continuous process at low cost.

The solution of this problem provides that in a sound insulating element of this kind the coating which is to be oriented towards the room includes an array of openings forming a regular hole pattern and penetrating the coating as far as to the insulation element.

Concerning the process according to the invention, the solution provides that a layer of a hydraulically and/or chemically setting mass which is to be provided as a coating separable from a flexible support is applied to this flexible support, that an insulation element from mineral fibers bound with a binding agent is placed onto the mass which has not yet set, that the mass is subsequently cured and that after curing the coating is provided with a regular hole pattern including openings penetrating the coating as far as to the insulation element.

The sound insulating element according to the invention is thus comprised of a mineral fiber board and a coating that is made for instance from Sorel cement or modified water glass mortar. The sound insulation properties of this sound insulating element are considerably improved by a regular hole pattern. For this purpose it is provided that the openings of the hole pattern penetrate the entire coating as far as to the insulation element which is made from mineral fibers bound with binding agents. A sound insulating element of this kind can be arranged particularly in the ceiling area of underground parking, where it provides for an aesthetic appearance of the ceiling designed in this way, due to the regular pattern of holes, and this ceiling is clearly different from ceilings known in the above-mentioned prior art and comprising wood wool slabs, also called "Sauerkrautplatten". Due to the materials which are used such an insulating element exhibits particular properties with regard to flammability, so that it can be rated fire class A1 (EN 13501).

Further features of the invention will become apparent from the subclaims, and the important improvements of the sound insulating element according to the invention or of the process according to the invention will be described in more detail in the following.

According to the invention a bulk density of the mineral fiber insulation element of between 70 and 140 kg/m$^3$, in particular of between 70 and 90 kg/m$^3$ is provided, so that the mounting of such sound insulating elements in the ceiling area can be made much easier than the mounting of prior art insulating elements having bulk densities of between 110 and 160 kg/m$^3$ already at the level of the insulation elements. The coatings which are additionally used and which consist of cement-bound wood fibers exhibit bulk densities from 700 to 900 kg/m$^3$ in addition to a material thickness of approximately 7.5 mm. In contrary thereto a cover layer is provided in the sound insulating element according to the invention which, though having a high bulk density of 1,400-2,000 kg/m$^3$, preferably 1,600 to 1,700 kg/m$^3$, merely has a material thickness of between 2 and 5 mm, particularly of between 2 and 2.5 mm.

The hole pattern includes openings with an aperture area of 10 to 50%, in particular of 18 to 25%, referred to the total area of the coating, which results in particularly advantageous sound insulation properties. The invention further provides that the insulating element has a fiber orientation parallel to the large surfaces, whereby an improved heat insulation of the entire sound insulating element can be achieved. Although such a laminar orientation of the mineral fibers exhibits a low tearing strength and a low compressive strength compared to the lamellar structure known from prior art, this tearing strength and also this compressive strength are compensated by the use of a different coating, which simultaneously achieves an improved thermal conductivity, as mentioned above, and thus an improved thermal insulation.

Finally, compared to an insulating element according to prior art, greater material thicknesses can be provided in the mineral fiber insulation element of the insulating element according to the invention, because at an equal total thickness of the insulating elements to be compared, the sound insulating element according to the invention exhibits a lesser material thickness of the cover layer and moreover also includes only one cover layer, so that for improving the sound and heat insulation properties a thicker mineral fiber insulation element can be used, without a greater ceiling height being required at the installation of the sound insulating element in order to obtain the ceiling height of e.g. 2 m required in the underground parking area after the installation of the sound insulating elements.

Differently from prior art the sound insulating element according to the invention has the advantage, due to the above-described orientation of the fibers relative to the larger surfaces, that such insulation elements can be manufactured much cheaper than insulation elements having a lamellar structure.

In the sound insulating element according to the invention an averaged sound absorption coefficient $\alpha_w$ of between 0.9 and 1.0 (ISO 11654) is provided.

To provide for sufficient strength of the coating, a further feature of the invention provides that the coating is reinforced by at least one layer of a glass fiber lattice. Of course, also more layers of a glass fiber lattice can be embedded in the coating.

Due to the construction with a regular hole pattern including a plurality of openings especially arranged equally spaced to each other and preferably having an identical geometry, a highly aesthetic sound insulating element is provided which compared to prior art offers an extremely aesthetic optical appearance also in underground parking areas and similar utility rooms. The coatings can also be colored as desired by the individual customer. Any additional paint is not required.

Even if an additional paint should be desired the paint can be applied much easier than to the wood/wool/slabs which have an irregular surface and are thus more difficult to paint.

Sound insulating elements according to the invention can be easily adhered to ceilings, but it is also possible to mechanically fix the sound insulating elements to the ceiling by means of dowels or claws. Moreover, such sound insulating elements can be inserted in rail systems which have been previously mounted to the ceiling. Finally it is possible to install such sound insulating elements as a so-called lost formwork. For this purpose sound insulating elements according to the invention are placed adjacent to each other and flush with each on formwork to be removed at a later time, and a reinforcement is arranged at a distance provided by spacers, before a concrete ceiling is cast onto the sound insulating elements under inclusion of the reinforcement.

The connection between the concrete ceiling and the sound insulating elements is obtained here by means of anchoring springs such as described for example in WO 2004/016871 A2, which are driven into the insulation elements made of mineral fibers bound with binding agents.

If the sound insulating elements according to the invention are processed as a so-called lost formwork, the same are temporarily subject to local loads when they are walked on during the construction of the ceiling. To increase the resistance of the sound insulating elements, a further improvement according to the invention provides that the insulation elements are furnished with a mineral fiber layer in the region of their surface opposite to their surface having the coating, which mineral fiber layer has a higher bulk density than the insulation element. This can normally be a so-called sandwich element which consists of two layers of a mineral fiber insulation element, which layers are bonded together. Alternatively, also a mineral fiber insulation element can be provided which has an increased bulk density in the region of its large surface, due to a mechanical treatment, so that the insulation element having the two regions of a different bulk density is constructed monolithically. Thus the advantage is achieved that no additional adhesive is to be used which could possibly prevent a favorable fire class rating of such a sound insulating element. The construction of the sound insulating element with a surface layer having an increased bulk density also improves the support of the anchoring springs to be inserted in this region, since these anchoring springs, at least most of them, are arranged in the layer with the increased bulk density.

A further improvement of the process according to the invention provides that the support, which may be a plastic film for instance, is removed prior to making the openings. But it is also possible to make the openings through the support. The support can be removed for instance in the course of curing the coating in a hardening furnace by melting or burning the support due to the high temperature produced in the hardening furnace, so that the sound insulating element leaves the hardening furnace without the support.

Preferably the openings are made in the form of bores, although making the openings in the coating by means of a laser or by a punching operation turned out to be a further improvement. In any a case a cured coating is provided for this purpose and the curing process prior to making the openings can also constitute only a part of the entire curing process. If for instance a Sorel cement coating is provided, hardening takes place for at least 45 minutes. After this time period it is possible to make openings in the coating. Thereafter the panels are cut and are then subject to a secondary hardening for 24 hours for instance. The curing process can be accelerated by using a hardening furnace.

Preferably the mass forming the coating is applied to an endless support, for example to the above-mentioned plastic film, in a continuous process and covered by a mineral fiber web produced in a continuous process, and after curing the coating and the mineral fiber web are separated into individual panel-shaped insulation elements. For separating the coating and the mineral fiber web a saw or also a laser beam can be provided. Of course, also a water jet cutting operation can be performed.

As far as the above-described process is a process for producing a mineral fiber web, the procedure is one which is known per se, in which a silicate material, for instance rock or glass material is melted and the melt is supplied to a defibration unit defibering the melt into microfine fibers which are subsequently wetted with binding and/or impregnating agents and collected in a so-called collecting chamber. In this case this web is called a primary web which is then subject to further processing steps, such as forming accordion-like folds and trimming the edges or the like, so that a mineral fiber web is produced which is then applied to the support, with the interposition of the mass forming the coating. The support, which may be a plastic film for example, is then withdrawn from a supply roll over a conveyor belt, thus forming the separating layer between the mass and the conveyor belt, so that the mass cannot stick to the conveyor belt.

The above-described sound insulating element can have a hole pattern which consists of a plurality of holes combined into groups comprising four holes and altogether forming a rectangle. An additional opening may be provided which is arranged centrally between the aforementioned four openings.

Further features and advantages of the invention will become apparent from the following description of the attached drawings showing a preferred embodiment of the invention. In the drawings it is shown by:

FIG. 1 a perspective view of a sound insulating element and

Figure 2:
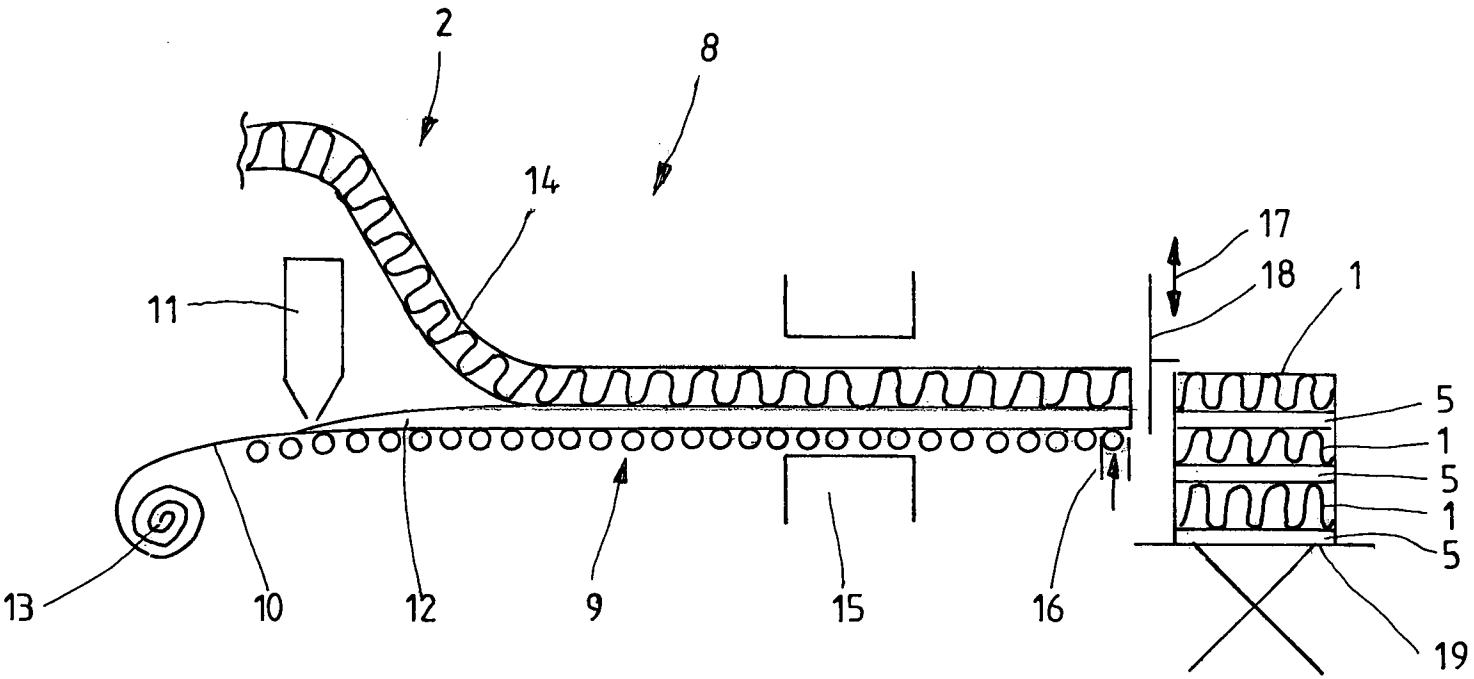

FIG. 2 a system for manufacturing a sound insulating element according to FIG. 1.

A sound insulating element 1 illustrated in FIG. 1 consists of an insulation element 2 made from mineral fibers bound with binding agents and comprising a first layer 3 having a first bulk density of 75 kg/m$^3$ and a second layer 4 having a bulk density of 140 kg/m$^3$. The two layers 3 and 4 form a monolithic insulation element 2.

The insulation element 2 has a large surface on which a coating 5 made of a hydraulically set mass, for instance Sorel cement with a bulk density of 1,600 kg/m$^3$, is arranged. The coating 5 is arranged over the full area of the insulation element 2 and includes a reinforcement 6 consisting of a layer of a glass fiber lattice.

Instead of Sorel cement also a modified water glass mortar can be applied.

It can be seen in FIG. 1 that the coating 5 has a plurality of openings 7 forming a regular hole pattern in the coating 5, the hole pattern with the openings 7 having an aperture area of 20% referred to the entire area of the coating 5. The openings are arranged at equal distances to each other and have an identical geometry, i.e. the openings conform to each other in shape and size and especially in diameter in the case of circular openings 7.

The coating has a material thickness of 2 mm. Compared thereto the insulation element from mineral fibers bound with a binding agent and having a fiber orientation parallel to the large surfaces of the insulation element 2 has a material thickness from 48 to 178 mm, resulting in a total thickness of the sound insulating element of between 50 and 180 mm. With a corresponding sound insulating element 1 an averaged sound absorption coefficient $\alpha_w$ of between 0.9 and 1.0 is achieved.

FIG. 2 schematically illustrates a system suitable for producing a sound insulating element according to claim 1.

This system 8 includes a conveyor device in the form of a roller bed 9 over which a support 10 is pulled. The support 10 can be a plastic film for instance. Through a supplying device 11 a hydraulically and/or chemically setting mass 12 is applied to the support 10 which, when set, forms the coating 5 of the sound insulating element 1. The support 10, which is withdrawn from a supply roll 13, is continuously guided over the roller bed 9, so that a layer from the support 10 and the mass 12 is continuously formed on the roller bed 9. Onto this layer the insulation element 2 in the form of a mineral fiber web 14 is placed, and the mineral fiber web 14 becomes connected to the mass 12, if necessary under introduction of compression forces, before the mineral fiber web 14 together with the mass 12 and the support 10 is supplied to a hardening furnace 15 in which at least the mass 12 is cured to a certain extent for forming the coating, so that the support 5 can be subsequently removed from the coating 5. Normally also the binding agent of the mineral fiber web 14 is cured in the hardening furnace 15.

After the hardening furnace 15 and after removing the support 10, the openings 7 (cf. FIG. 1) are made in the coating 5 by using a drilling system 16. The drilling system 16 is comprised of a plurality of drills which are arranged in several rows and side by side in the conveying direction of the mineral fiber web 14, the drills in the individual rows and the rows one under the other being arranged at regular intervals.

After making the openings 7 in the coating 5 the mineral fiber web 14 together with the coating 5 is separated into individual sound insulating elements 1 by a cutting device 18 movable up and down in the direction of arrow 17. The individual sound insulating elements 1 are stacked one on top of the other on a stacking table 19 and are passed on to a packaging device not further shown, as soon as a predetermined stacking height has been achieved.

LIST OF REFERENCE NUMBERS

1 sound insulating element
2 insulation element
3 layer
4 layer
5 coating
6 reinforcement
7 opening
8 system
9 roller bed
10 support
11 supply device
12 mass
13 roll
14 mineral fiber web
15 hardening furnace
16 drilling system
17 arrow
18 cutting device
19 stacking table

The invention claimed is:

1. A process for producing a sound insulating element for the ceiling area of a building comprising an insulation element made from mineral fibers bound with a binding agent and having two mutually spaced surfaces extending parallel to each other, and a coating from a hydraulically and/or chemically set mass, wherein the coating is connected to the insulation element and is oriented towards the room and includes an array of openings forming a regular hole pattern and penetrating the coating as far as to the insulation element, the process being characterized in that a layer of a hydraulically and/or chemically setting mass which is to be provided as a coating separable from a flexible support is applied to this flexible support, that an insulation element from mineral fibers bound with a binding agent is placed onto the mass which has not yet set, that the mass is subsequently cured and that after curing the coating is provided with a regular hole pattern including openings penetrating the coating as far as to the insulation element.

2. The process according to claim 1, characterized in that the support is removed prior to making the openings.

3. The process according to claim 1, characterized in that the openings are formed as bores.

4. The process according to claim 1, characterized in that the openings are arranged equally spaced to each other, so that the openings constitute an aperture area of 10 to 50%, referred to the total area of the coating.

5. The process according to claim 1, characterized in that the coating is reinforced by a least one reinforcement in the form of a glass fiber lattice.

6. The process according to claim 1, characterized in that the mass constituting the coating is applied to an endless support in a continuous process and is covered by a mineral fiber web produced in a continuous process, and that the coating and the mineral fiber web are separated into individual sound insulating elements after curing of the coating.

7. The process according to claim 1, characterized in that the openings in the coating are made by means of a laser and/or by punching.

8. A sound insulating element for the ceiling area of a building for a room subject to increased humidity produced by the process according to claim 1, which sound insulating element comprises an insulation element made from mineral fibers bound with a binding agent and having two mutually spaced large surfaces extending parallel to each other, and of a coating from a hydraulically and/or chemically set mass, wherein the coating is connected to the insulation element, characterized in that the coating to be oriented towards the room includes an array of openings forming a regular hole pattern and penetrating the coating as far as to the insulation element.

9. The sound insulating element according to claim 8, characterized in that the hole pattern includes a plurality of mutually equally spaced openings of identical geometry.

10. The sound insulating element according to claim 8, characterized in that the hole pattern includes openings with an aperture area of 10 to 50%, referred to the total area of the coating.

11. The sound insulating element according to claim 10, characterized in that the hole pattern includes openings with an aperture area of 18 to 25%, referred to the total area of the coating.

12. The sound insulating element according to claim 8, characterized in that the coating is constructed from a Sorel cement mass and at least one layer of a reinforcement embedded in the Sorel cement mass.

13. The sound insulating element process according to claim 12, wherein the reinforcement is a glass fiber lattice.

14. The sound insulating element according to claim 8, characterized in that the coating is made from a modified water glass mortar.

15. The sound insulating element according to claim 8, characterized in that the insulation element has a bulk density of between 70 and 140 kg/m$^3$.

16. The sound insulating element according to claim 15, characterized in that the insulation element has a bulk density of between 70 and 90 kg/m$^3$.

17. The sound insulating element according to claim 8, characterized in that the insulation element has a fiber orientation parallel to the large surfaces.

18. The sound insulating element according to claim 8, characterized in that the insulation element is formed in the region of its surface opposite to its surface having the coating with a layer having a bulk density which is increased compared to the insulation element.

19. The sound insulating element according to claim 18, characterized in that the coating is a layer of mineral fibers.

20. The sound insulating element according to claim 8, characterized in that the coating has a thickness of between 2 and 5 mm.

21. The sound insulating element according to claim 8, characterized in that the coating has a bulk density of between 1,600 and 1,700 kg/m$^3$.

22. The sound insulating element according to claim 8, characterized by an averaged sound absorption coefficient $\alpha_w$ of between 0.9 and 1.0.

23. The sound insulating element according to claim 8, wherein the room subject to increased humidity is for underground parking or a basement.

* * * * *